US008074541B2

(12) United States Patent
Adamany et al.

(10) Patent No.: US 8,074,541 B2
(45) Date of Patent: Dec. 13, 2011

(54) PORTABLE TOOL KIT WITH AUTO-RELEASE CLASP AND EXPANDABLE TOOLS

(75) Inventors: Richard C. Adamany, Chagrin Falls, OH (US); Bennett S. Rubin, Pepper Pike, OH (US)

(73) Assignee: InterDesign, Inc., Solon, OH (US)

( * ) Notice: Subject to any disclaimer, the term of this patent is extended or adjusted under 35 U.S.C. 154(b) by 0 days.

(21) Appl. No.: 12/806,711

(22) Filed: Aug. 19, 2010

(65) Prior Publication Data

US 2010/0319138 A1 Dec. 23, 2010

Related U.S. Application Data

(63) Continuation of application No. 12/120,670, filed on May 15, 2008, now Pat. No. 7,810,415.

(51) Int. Cl.
*B25F 1/00* (2006.01)
*B25B 23/18* (2006.01)
*B25G 1/08* (2006.01)

(52) U.S. Cl. ..... 81/440; 7/119; 362/119; 81/490

(58) Field of Classification Search ..... 81/440, 81/177.4, 436–439, 490; 7/119, 118, 165, 7/168; 206/223, 372, 752, 234; 362/119, 362/120

See application file for complete search history.

(56) References Cited

U.S. PATENT DOCUMENTS

| | | | | |
|---|---|---|---|---|
| 2,173,042 | A | 9/1939 | Picard | |
| 4,384,499 | A | 5/1983 | Shockley | |
| 4,570,341 | A * | 2/1986 | Konneker | 7/118 |
| 4,836,066 | A | 6/1989 | Graham et al. | |
| 5,062,173 | A * | 11/1991 | Collins et al. | 7/118 |
| 5,491,856 | A | 2/1996 | Legg | |
| 5,553,340 | A | 9/1996 | Brown, Jr. | |
| 5,564,318 | A | 10/1996 | Pail | |
| D427,875 | S | 7/2000 | Chiu | |
| 6,112,351 | A | 9/2000 | Hawkins et al. | |
| 6,460,698 | B1 | 10/2002 | Wang | |
| 6,564,678 | B1 | 5/2003 | Wang | |
| 6,751,819 | B2 | 6/2004 | Chuang | |
| 6,868,760 | B1 | 3/2005 | Johnson | |
| 7,036,174 | B2 * | 5/2006 | Painsith et al. | 7/118 |
| 7,146,889 | B2 | 12/2006 | Kang | |
| 7,343,838 | B2 * | 3/2008 | Tansbo et al. | 81/440 |

* cited by examiner

*Primary Examiner* — Hadi Shakeri
(74) *Attorney, Agent, or Firm* — D. Peter Hochberg; Sean F. Mellino; Daniel J. Smola

(57) ABSTRACT

A portable tool kit comprising a self-releasing clasp such that the clasp is released as a main body is rotated about a handle axle from a closed position to an open position with reference to a handle assembly. The main body and handle assembly cooperate to wholly enclose a set of tools when in the closed position. When in an open position, the tools of the main body are exposed to selection and rotation about a rivet of the main body cooperating with a biasing device of a biasing rivet of the main body to hold the tool in place. When fully extended, the main body and handle assembly permit the selection of a plurality of tools such as Phillips head and flat head screwdrivers of different sizes for extension from within the main body for use. Moreover, lamps may be provided on either end of the handle assembly for illuminating a work area.

8 Claims, 7 Drawing Sheets

PORTABLE TOOL KIT WITH AUTO-RELEASE CLASP AND EXPANDABLE TOOLS

This application is a continuation of U.S. patent application Ser. No. 12/120,670 filed on May 15, 2008.

BACKGROUND OF THE INVENTION

1. Field of the Invention

The technical field relates to a portable took kit, in particular, a compact portable tool kit comprising a plurality of tools, for example, screw drivers of varying sizes and types having a clasp, such as a ring, for holding keys or fixing the tool kit to a pants loop, the tools being accessible from a wholly enclosing handle and main body for use.

2. Description of the Prior Art

Tool kits are known for specific purposes such as portable tool kits for repairing bicycles or repairing tires. Examples of tool kits known in the art include those disclosed in U.S. Pat. Nos. 4,384,499 showing slide-out and swing-out tools; 6,112,351 showing a clam shell containing tools for bicycle repair; 6,564,678 showing a tool kit combination including magnetic attraction members; 6,751,819 disclosing a tool assembly with a tire repairing wrench and having sidewalls; 6,868,760 showing a tool locking mechanism; and 7,146,889 showing a plurality of tools mounted among four half plates.

U.S. Pat. No. 5,491,856 provides a releasable key ring or the like which is held in place within an aperture of the gripping jaws of a tool having handles which rotate into an open position. When in the open position, the tool releases the key ring. Consequently, for example, the user may leave their keys in an automobile while using the tool with the gripping jaws in its expanded form for repair or other purposes.

SUMMARY OF THE INVENTION

One aspect of one embodiment of a portable tool kit is to provide an auto-releasable clasp. Such a clasp may comprise one of a plurality of shapes such as a ring, a rectangular shape, an oval shape or other shape for fastening the portable tool kit, for example, to another tool, to an article of clothing or a set of keys. A clasp locking element is provided proximate a distal end of an elongated handle portion of the portable tool kit. The clasp locking element is substantially cylindrical in shape and is further provided with a groove running its length and provided at a predetermined angle from and perpendicular to the linear direction of the handle. The cylinder of the clasp locking element comprises a central aperture for receiving a handle axle for coupling a right and a left handle assembly of the elongated handle and a main body holding the tools such that the tools are wholly contained within the assembly formed of the handle assembly and main body in a closed position. When the clasp locking element is rotated, for example, along with the main body, the groove is rotated as well to a position for releasing the clasp. In this manner, the clasp may stay fixed in place while the tool kit is released for use by rotating the main body to the predetermined angle in relation to the handle assembly.

A further aspect of one embodiment of a portable tool kit according to the invention is to adapt the right and left handle assembly portions to permit the main body to move rotatably outwardly about the handle axle to an extended position. From this extended position, there may now appear the tools mounted about first and second tool rivets. For example, three screwdrivers may be mounted for rotation about each rivet making six screw drivers in all that may be rotated into place. One tool, for example, of the six selectable tools may be rotated about the tool rivet and held in place by a biasing device of a biasing rivet of the main body. As will be explained further herein, the rivet may comprise a conventional rivet or a doubly threaded bolt or other elongated fixing device.

One embodiment of a portable tool kit thus may comprise in summary a handle assembly and a main body having an indentation at its distal end. The handle assembly and main body wholly cover a set of tools located within the main body in a closed position, the main body and the handle assembly adapted for rotation about a distal handle axle. The distal handle axle cooperates with a clasp locking element having a groove at a predetermined angle of rotation and a lip for locking a releasable clasp. The main body contains a cooperating indentation at its distal end such that, upon rotation to the predetermined angle of the groove of the clasp locking element, the clasp is automatically released from the tool kit in cooperation with the distal indentation of the main body. The main body and the handle assembly when rotated about the handle axle open to expose the set of tools, the main body comprising a pair of tool rivets for mounting tools at one end and a pair of rivets for mounting biasing devices at the other end. The main body opens from the handle assembly to permit selection of one of a plurality of tools for rotation about an associated tool rivet to an extended position to be locked in place by a biasing device of an associated biasing rivet.

The right and left handle assembly may be further equipped with light emitting diodes or other lamps for illuminating a work area at either or both ends. Batteries for the lamps may be provided under removable grip portions of right and left handle assembly portions and an electric switch provided on the grips for each pair of lamps.

These and other features and aspects will become known to one of skill in the art from the following detailed description of an illustrative embodiment.

DETAILED DESCRIPTION OF THE PREFERRED EMBODIMENTS

Figure 1:
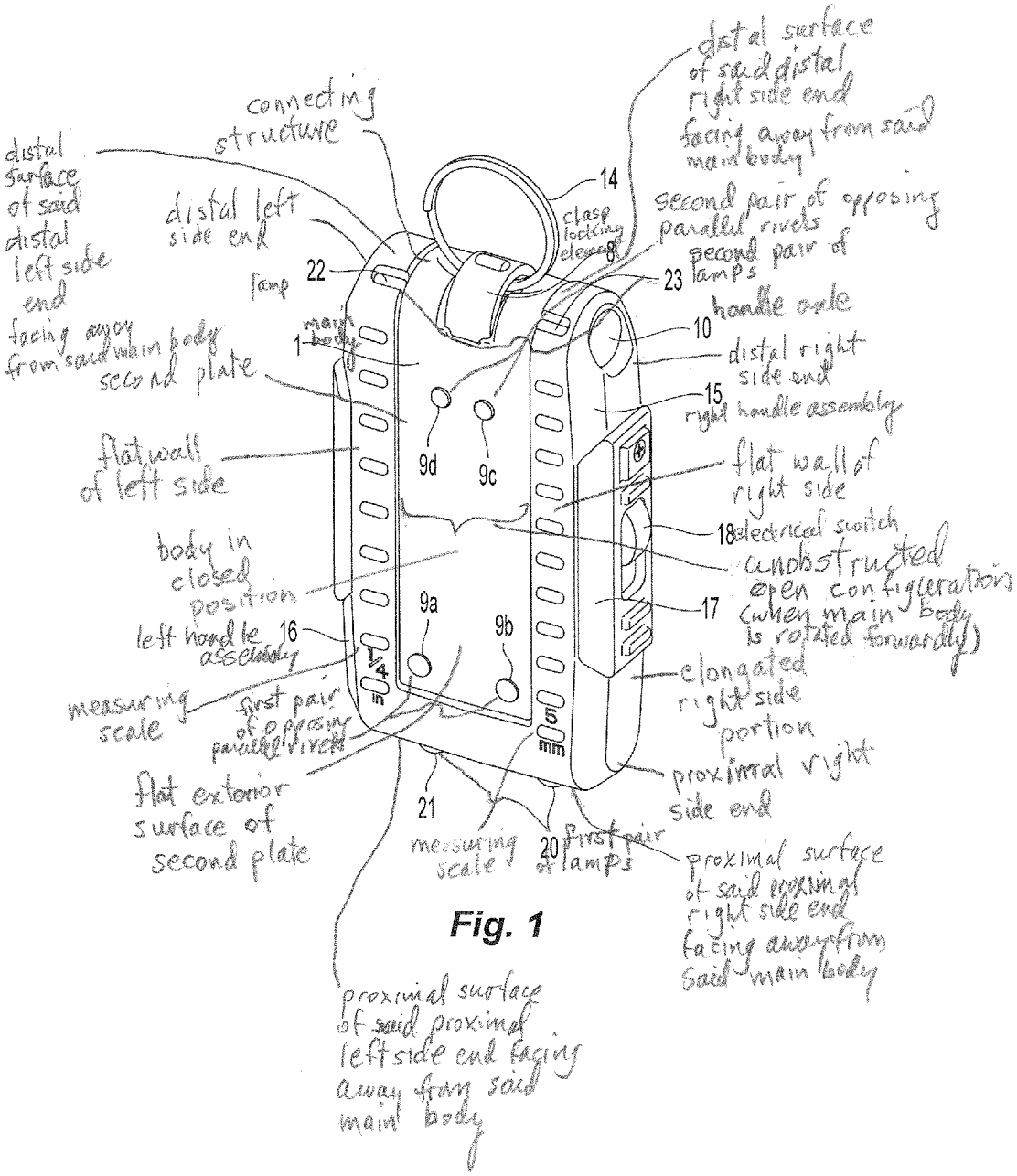
FIG. 1 provides a front perspective view of an embodiment of a portable tool kit having a releasable clasp and expandable tools in a collapsed, portable mode.
Figure 2:
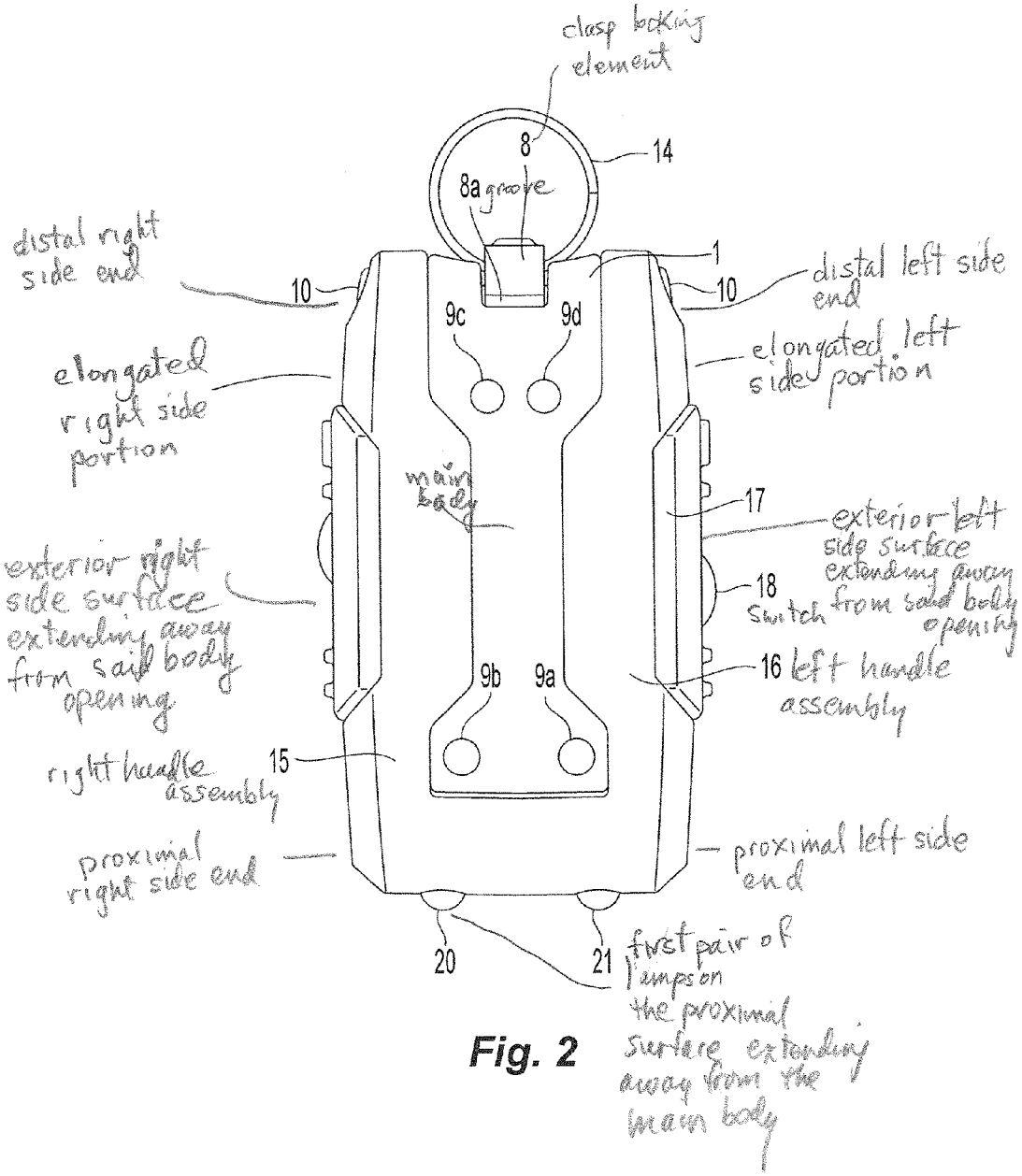
FIG. 2 provides a rear elevational view of an embodiment of a portable tool kit in accordance with FIG. 1.
Figure 3:
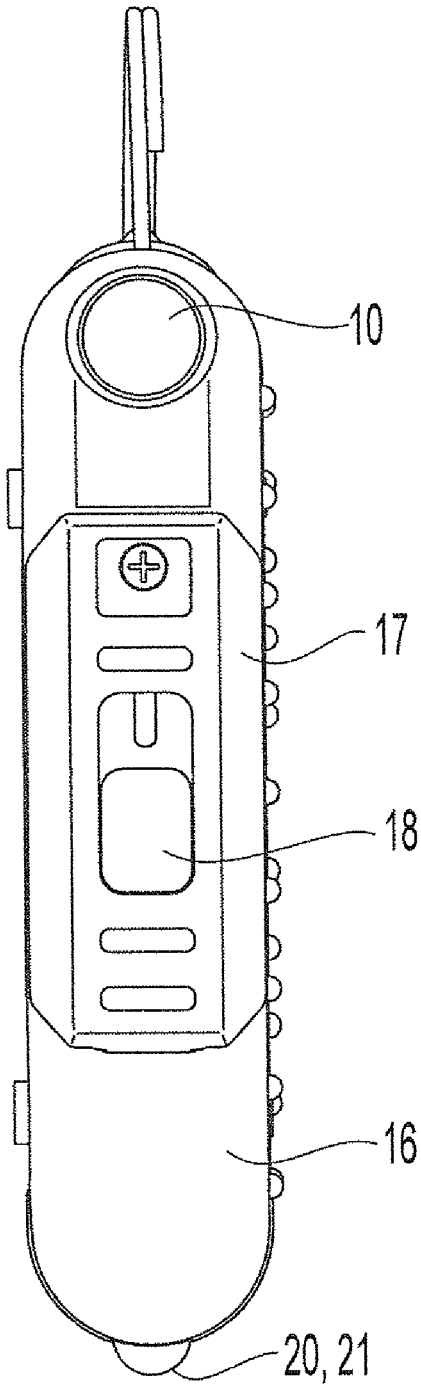
FIG. 3 provides a side elevational view of an embodiment of a portable tool kit in accordance with FIG. 1.

Similar reference characters will be used throughout the drawings to denote similar elements. Referring to FIGS. 1-7, there is shown a clasp 14 and, per FIG. 1, a perspective view of a front side of a portable tool kit. Clasp 14 may be of any size or shape useful for affixing the depicted tool kit to another tool, set of keys, article of clothing or the like. The front side shown in FIG. 1 may provide ¼ inch and 5 mm scales shown by way of example on left and right handle assemblies 15 and 16. The scales may, in an alternative embodiment, be provided on the reverse side, FIG. 2, or provided with a tool within the housing comprising left and right handle assemblies 15 and 16 and main body 1. Main body 1 and left and right handle assemblies wholly enclose tools (not shown in FIG. 1, 2 or 3). One grip 17 of right handle assembly 15 is shown in FIG. 1 comprising an electrical switch 18 for turning on all or respective pairs of lamps 20-23 at one or the other end of the portable tool kit. For example, switch 18 may provide power to illuminate lamps 20 and 21 while a switch on the opposite grip may provide power to lamps 22 and 23. Underneath the grip 17 (or opposite grip) may be located batteries (not shown) for powering pairs 20, 21 or 22, 23 of lamps for the respective switch or all the lamps 20-23. In one embodiment, the lamps 20-23 may comprise light emitting diodes or other lighting devices known in the art.

Figure 4:
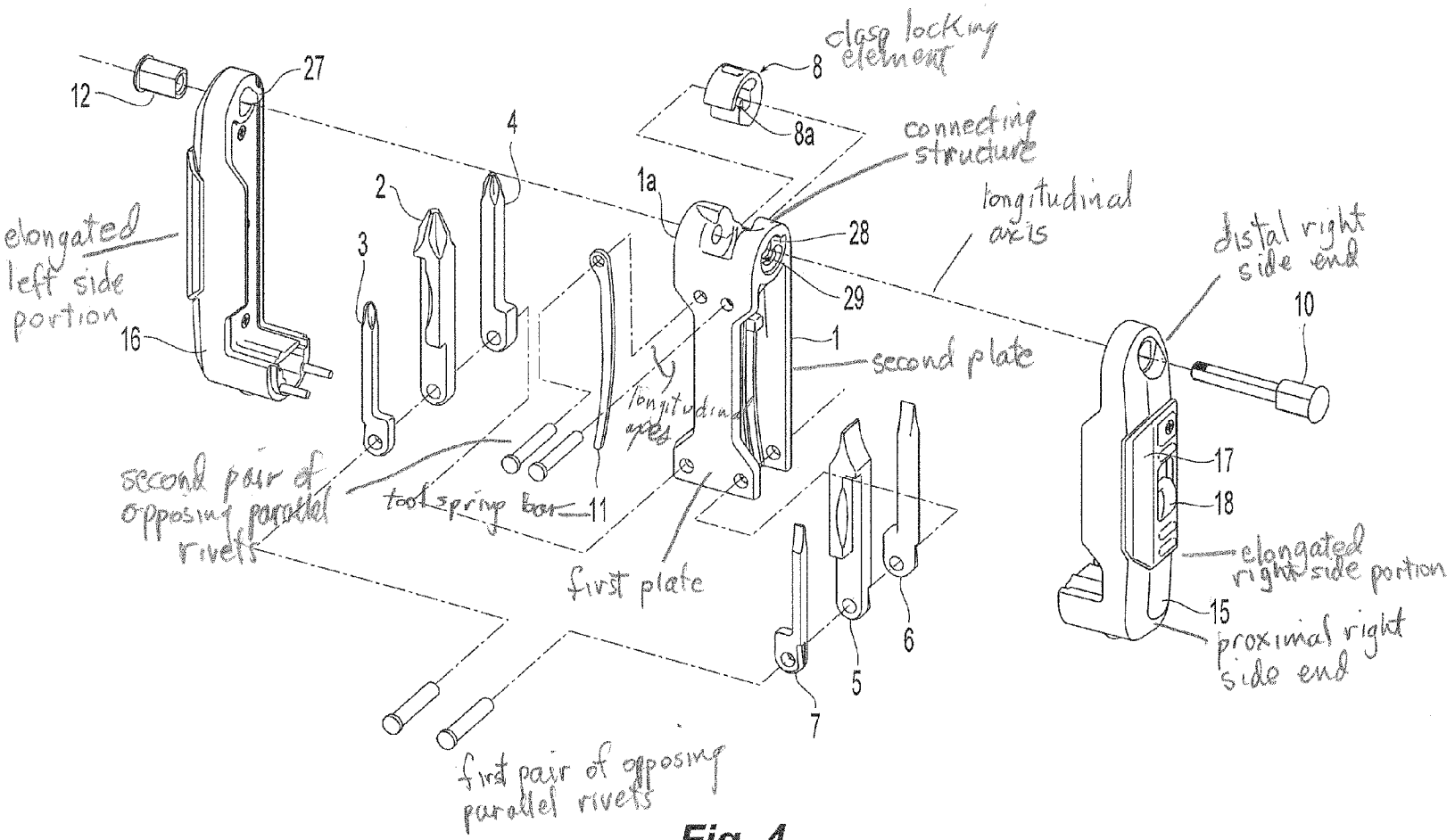
FIG. 4 provides an exploded view of an embodiment of a portable tool kit in accordance with FIG. 1.
Figure 5:
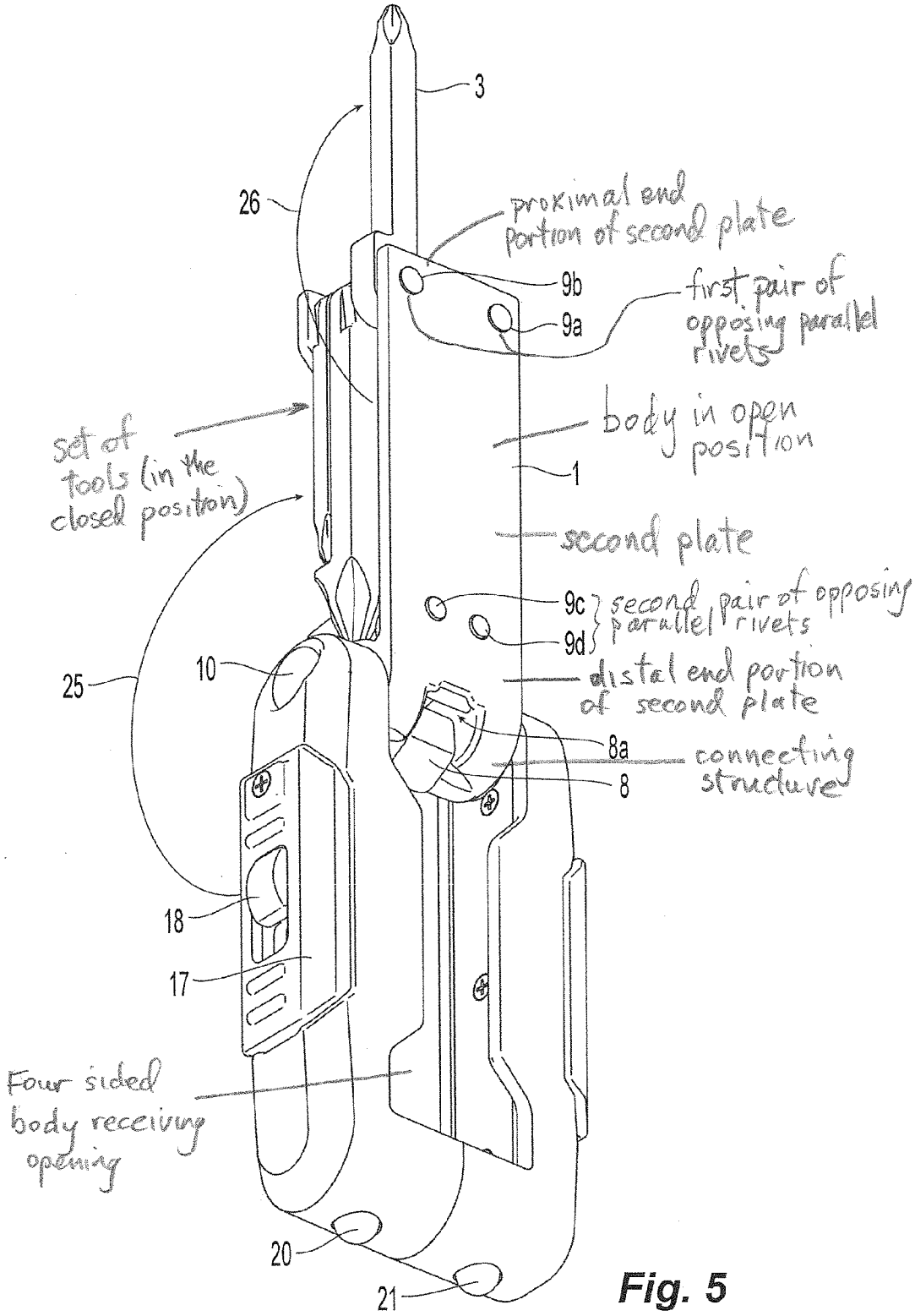
FIG. 5 provides a perspective view with the portable tool kit expanded to show one of a plurality of tools, for example, a screw driver, in an extended position and ready for use, a clasp (shown in FIG. 1) having been automatically released from the portable tool kit when the main body is rotated to a predetermined angle to expose a releasing groove of the clasp locking element.

Rivets 9*a*-9*d* are seen in main body 1 for securing tools or biasing devices for the tools not seen in FIG. 1 but which are visible in FIGS. 4 and 5. For example, on one tool rivet, for example, rivet 9*b*, may be mounted three tools as may be seen in FIG. 4: a #0 Phillips screwdriver 3, a #2 Phillips head 2 and a #1 Phillips head 4. On another tool rivet, for example, rivet 9*a*, may be mounted on #0 flat head screwdriver 7, a #1 flat head screwdriver 6 and a #2 flat head screwdriver 5. On biasing rivet 9*c* may be mounted a tool spring bar or biasing device 11. The tool spring bar 11 may act similarly to the spring bar of a known jack-knife, holding a selected, extended tool in place as shown in FIG. 5.

Figure 7:
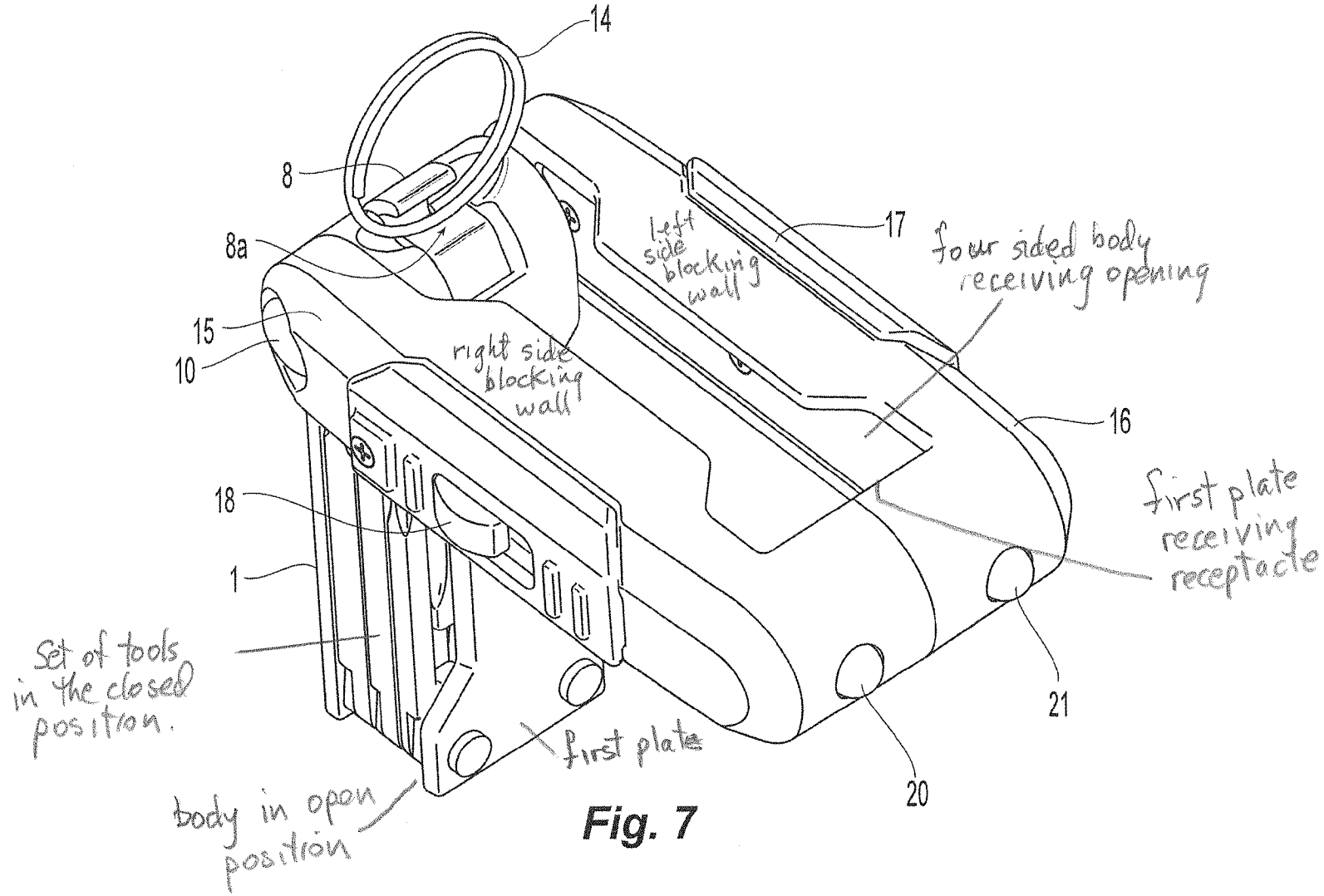
FIG. 7 provides a view of the tool kit opened to approximately 90° to show the clasp fully released by the clasp locking element.

Main body 1 rotates about handle axle 10 following direction of rotation 25 of FIG. 5 to an open position about handle axle 10 as may be seen from FIGS. 4 and 5 exposing the contents of main body 1. Handle axle 10 includes a handle axis 31 as shown in FIG. 4. The opposite or reverse side of main body 1 may be seen in FIG. 2. The opposite side has an hour glass or similar shape so that the main body 1 may rotate in one direction 25 about handle axle 10, but not in the other direction and can lock into place in its extended position as seen in FIG. 5. In FIG. 7, one can see the main body 1 rotated to approximately 90° from handle assembly 15, 16.

Handle axle 10 is coupled to a clasp locking element 8 having a groove 8*a* as best seen in FIG. 4. Clasp locking element also includes a clasp locking axis 33, which is coaxial with handle axis 31 when the portable tool kit is assembled. Handle axle 10 cooperates with handle rivet 12 to maintain handle axle 10 in place. The longitudinal groove 8*a* is adapted for the shape of clasp 14. The depicted clasp 14 comprises a key ring. In an alternative embodiment, the clasp may be a clasp of any size or shape and serve a multitude of purposes than a key ring such as for attaching the tool kit to another tool or tool kit, for attachment to an article of clothing or other purpose. The clasp releasing groove 8*a* is located at a predetermined angle from the linear direction of the main body/handle assembly 1, 15, 16. Consequently, in its closed position, as seen in either FIG. 1 or 2, the clasp 14 is held within a lip of clasp locking element 8. However, as the main body 1 is rotated toward an open position via arrow 25 of FIG. 5 and reaches the predetermined angle of groove 8*a*, the clasp is automatically released in cooperation with an indentation at the distal end of main body 1. The predetermined angle, for example, may be in the range of 50 to 130 degrees, for example, 90 degrees. Referring to FIG. 7, the clasp 14 is shown free of locking element 8 and released from groove 8*a*.

As best may be seen from FIG. 4, clasp locking element 8 is adapted for fixing by handle axle 10 in place while indentation 1*a* of main body 1 is free to rotate with main body 1. The indentation of main body 1 cooperates with groove 8*a* to release clasp 14 at the predetermined angle of rotation of main body 1 from handle assembly 15, 16 as seen, for example, in FIG. 7.

As best seen in FIG. 5, the main body 1 may reach a fully rotated position and lock in place such that handle assembly 15, 16 may be held in one hand and another hand used to grasp a selected tool for extension, 2, 3, 4, 5, 6 or 7. Referring briefly to FIG. 4, exploded view, there is shown a locking post 27 of assembly portion 16 which cooperates with one of grooves 28 and 29 to maintain main body 1 in either a closed or open position. A washer or spring (not shown) may surround locking post 27 for ease of opening or closing main body 1 from handle assembly 15, 16. See FIG. 6 for a side view of locking grooves 28, 29 of main body 1.

Figure 6:
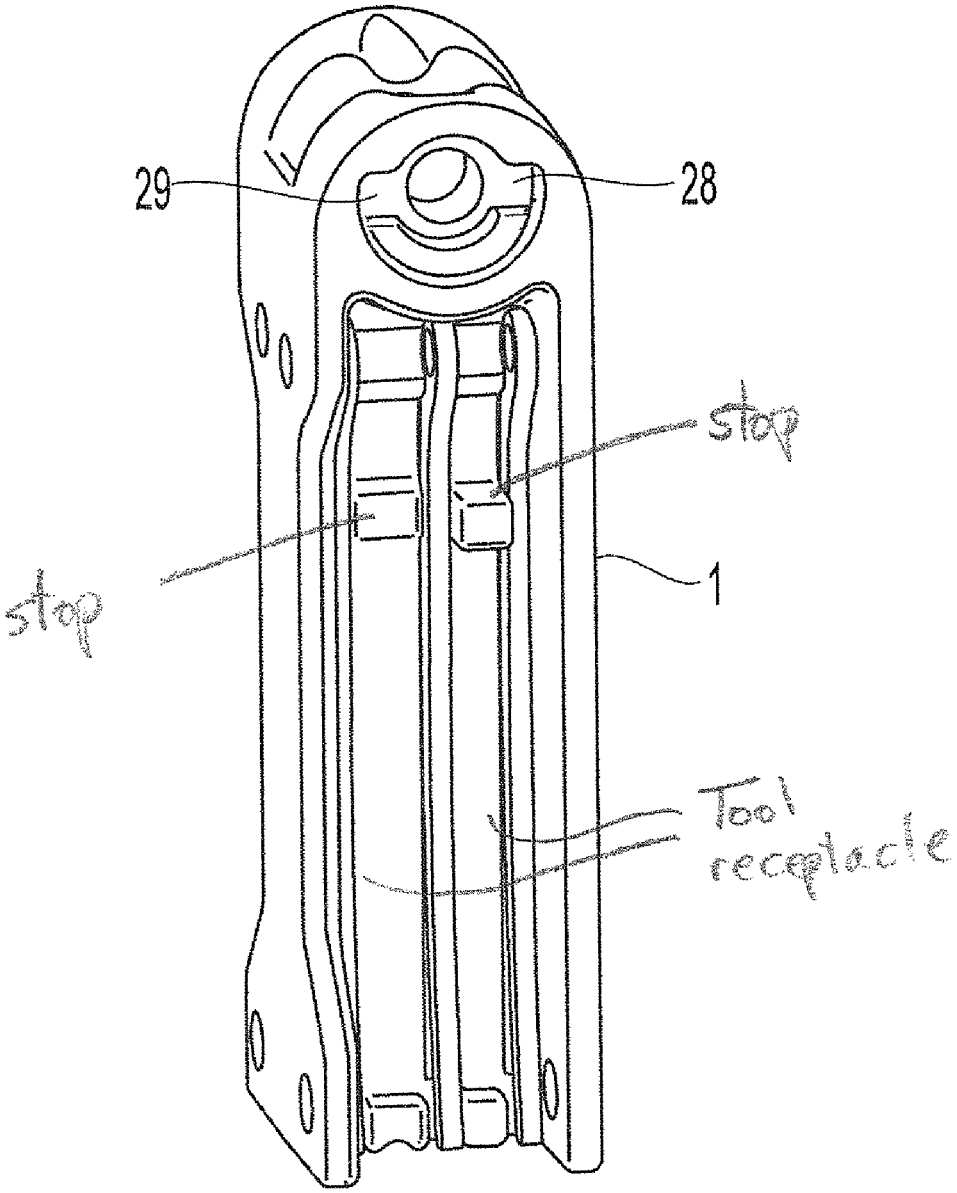
FIG. 6 provides a side view showing locking grooves for receiving a locking post of the handle assembly shown in exploded view FIG. 4.

FIG. 6 also shows a tool stop 30. Tool stop 30 comprises a projection extending perpendicularly to biasing devices 11 and away from main body 1. Tool stop 30 is located between biasing devices 11.

Screw drivers are shown in FIG. 5 by way of example of tools that may be extended from main body 1, for example. The type of tool is not intended to be limited to a screw driver; for example another tool may be an ice pick or another tool, a file. Also, more or fewer tools may be adapted to fit on tool rivets 9 than sets of three tools each, such as one, two, four or five tools. There may be one centrally located tool rivet and one associated biasing rivet 9 rather than two rivets 9 at each end of the main body 1 as depicted. The tools rotate outward from a closed to open position in a direction 26 which is in a plane perpendicular to the plane of rotation given by rotation direction 25 for main body 1. By way of example and as seen in FIG. 5, tool 3 is rotated open from main body 1 about tool rivet 9*b* and may be locked in place by a biasing device 11, shown in FIG. 4, for example, a tool spring bar. Rivets 9*b* and 9*a* may be referred to herein as a spring rivet 13 because they connect to biasing devices 11 for holding tools in place in a closed or open, ready-for-use position.

Lamps 22 and 23 may be switched to an on position by one of the switches 18 so that a user may illuminate a screw or bolt or, generally a work area. Similarly, in a closed position or open position the lamps 20 and 21 may be switched on and the frontal end of the handle may be used to more closely illuminate a work area.

While certain aspects of the depicted embodiment and alternative embodiments have been explained in detail with reference to the drawings, it is to be understood that further disclosed aspects of alternative embodiments may come to mind of one of skill in the art from reading the above detailed description. For example, the handle assembly and main body may form a water-proof container for the tools to assist in the prevention of the formation of rust. The main body and handle assembly may be formed of tough plastic or other tough material resistant to rotation while the tools may be formed of metal. The handle assembly and main body may be coated with a rubber or other gripping compound to promote better gripping by a user. The tool kit may be adapted for different known purposes such as car repair, tire repair, bicycle repair or other mechanical repair.

What is claimed:

1. A portable tool kit comprising a handle assembly and a main body;

said handle assembly including:

a left side having an elongated left side portion, a distal left side end and a proximal left side end;

an opposing parallel right side having an elongated right side portion, a distal right side end opposing said distal left side end and a proximal right side end opposing said proximal left side end; and a handle axle interconnecting said distal left side end and said distal right side end, said handle axle having a longitudinal axis;

wherein said proximal left side end and said proximal right side end are each interconnected to cooperate with each of said elongated left side portion, said handle axle and said elongated right side portion to define a generally four-sided body-receiving opening, said body-receiving opening having an unobstructed open configuration for receiving said main body, said left side and said right side having blocking walls for both defining both a first plate-receiving receptacle and for preventing said main body from moving past said blocking walls; and said main body being mounted for rotation between a closed position and a fully open position on said handle axle and having an axis of rotation coincident with the longitudinal axis of said handle axle, said main body including:

a first plate having a first plate configuration for being movable through said open configuration and for being received by said first plate-receiving receptacle;

a second plate having a second plate configuration for being movable into said open configuration and being prevented by said blocking walls from being movable past said blocking walls;

connecting structure for connecting said first plate and said second plate, said connecting structure cooperating with said handle axle for enabling said main body to be rotated relative to said handle assembly;

said first plate and said second plate having opposing distal end portions adjacent said handle axle, and having opposing proximal free end portions;

a first pair of opposing parallel rivets extending between said opposing proximal end portions of said first plate and said second plate, said first pair of opposing parallel rivets having longitudinal axes movable in response to the rotation of said main body about said handle axle and lying in planes perpendicular to the longitudinal axis of said handle axle;

a set of tools mounted on each of said first pair of opposing parallel rivets, said tools being rotatable between respective closed positions wherein at least one of said tools engage said blocking walls when said first plate is received in said receiving receptacle for preventing said main body from further rotation into said handle assembly and respective open positions rendering said respective tools in position for use;

a second pair of opposing parallel rivets extending between said opposing distal end portions of said first plate and said second plate, said second pair of rivets having longitudinal axes being parallel to the longitudinal axis of said first pair of opposing parallel rivets and being movable in response to the rotation of said main body about said handle axle in parallel planes respectively perpendicular to the longitudinal axis of said handle body;

a tool spring bar mounted on each of said second pair of opposing rivets for locking in place a respective tool in a respective open position;

said main body being rotatable between:

a closed position when said set of tools are all in the respective closed positions, wherein said first plate is received in said first plate-receiving receptacle; and an open position wherein said second plate is disposed outside of said body-receiving opening.

2. A portable tool kit according to claim 1 wherein said main body includes tool receptacles for said respective tools for receiving the respective tools in the respective closed positions, said tool receptacles including respective stops for engaging said respective tools in said respective tool receptacles for preventing further movement of said respective tools in said respective receptacles.

3. A portable tool kit according to claim 1 wherein said left side and said right side of said handle assembly have parallel, generally flat walls on opposite sides of said unobstructed open configuration, and wherein said second plate has a generally flat exterior surface when said main body is in the closed position;

said generally flat exterior surface of said second plate is flush with said flat walls of said handle assembly in response to said first plate entering said first plate-receiving receptacle.

4. A portable tool kit according to claim 1 and further including a clasp-locking element mounted on said handle axle, said clasp-locking element having a groove for receiving a clasp, and said main body with said connecting structure being rotatable on said handle axle with respect to said clasp;

said connecting structure covering and closing said groove when said main body is in the closed position and opening said groove when said main body is rotatable towards the fully open position.

5. A portable tool kit according to claim 1 wherein said elongated right side portion and said elongated left side portion have respective flat surfaces on opposite sides of said unobstructed open configuration, said respective flat surfaces having measuring scales.

6. A portable tool kit according to claim 1 wherein said elongated left side portion and said elongated right side portion have exterior left and right side surfaces facing away from said body-receiving opening, and wherein said proximal left side end and said proximal right side end have proximal surfaces facing away from said main body;

said portable tool kit further comprising:

a first pair of lamps disposed on said respective proximal surfaces facing away from said main body; and an electrical switch on one of said exterior left and right side surfaces for providing power to said first pair of lamps.

7. A portable tool kit according to claim 1 wherein said elongated left side portion and said elongated right side portion have exterior left and right side surfaces extending away from said body-receiving opening, and wherein said distal left side end and said distal right side end have distal surfaces facing away from said main body;

said portable tool kit further comprising:

a first pair of lamps disposed on said respective distal surfaces facing away from said main body; and an electrical switch on one of said exterior left and right side surfaces for providing power to said second pair of lamps.

8. A portable tool kit according to claim 7 wherein said proximal left side end and said proximal right side end have proximal surfaces facing away from said main body;

said portable tool kit further comprising:

a second pair of lamps disposed on said respective proximal surfaces facing away from said main body; and a second electrical switch on the other of said exterior left and right side surfaces for providing power to said first pair of lamps.

* * * * *